United States Patent [19]

Miller et al.

[11] 4,143,294

[45] Mar. 6, 1979

[54] GETTER SUPPORT MEANS FOR TELEVISION CATHODE RAY TUBES

[75] Inventors: Philip C. Miller, Northbrook; Michael W. Retsky, Chicago, both of Ill.

[73] Assignee: Zenith Radio Corporation, Glenview, Ill.

[21] Appl. No.: 886,859

[22] Filed: Mar. 15, 1978

Related U.S. Application Data

[62] Division of Ser. No. 708,817, Jul. 26, 1976.

[51] Int. Cl.[2] ..... H01J 29/64

[52] U.S. Cl. ..... 313/481; 313/174; 313/482

[58] Field of Search ..... 313/481, 174, 482

[56] References Cited

U.S. PATENT DOCUMENTS 2,275,864 3/1942 Record ..... 313/481 X

*Primary Examiner*—Robert Segal

*Attorney, Agent, or Firm*—Ralph E. Clarke, Jr.

[57] ABSTRACT

This disclosure depicts getter support means for use in television cathode ray tubes. A getter support means is structured so as to be retained in the tube by the outward, self-retaining pressure of an expansible member on the inner surface of the neck adjacent to the junction of the neck and the funnel of the tube envelope. Support for the getter assembly is provided by attachment to the expansible member.

8 Claims, 1 Drawing Figure

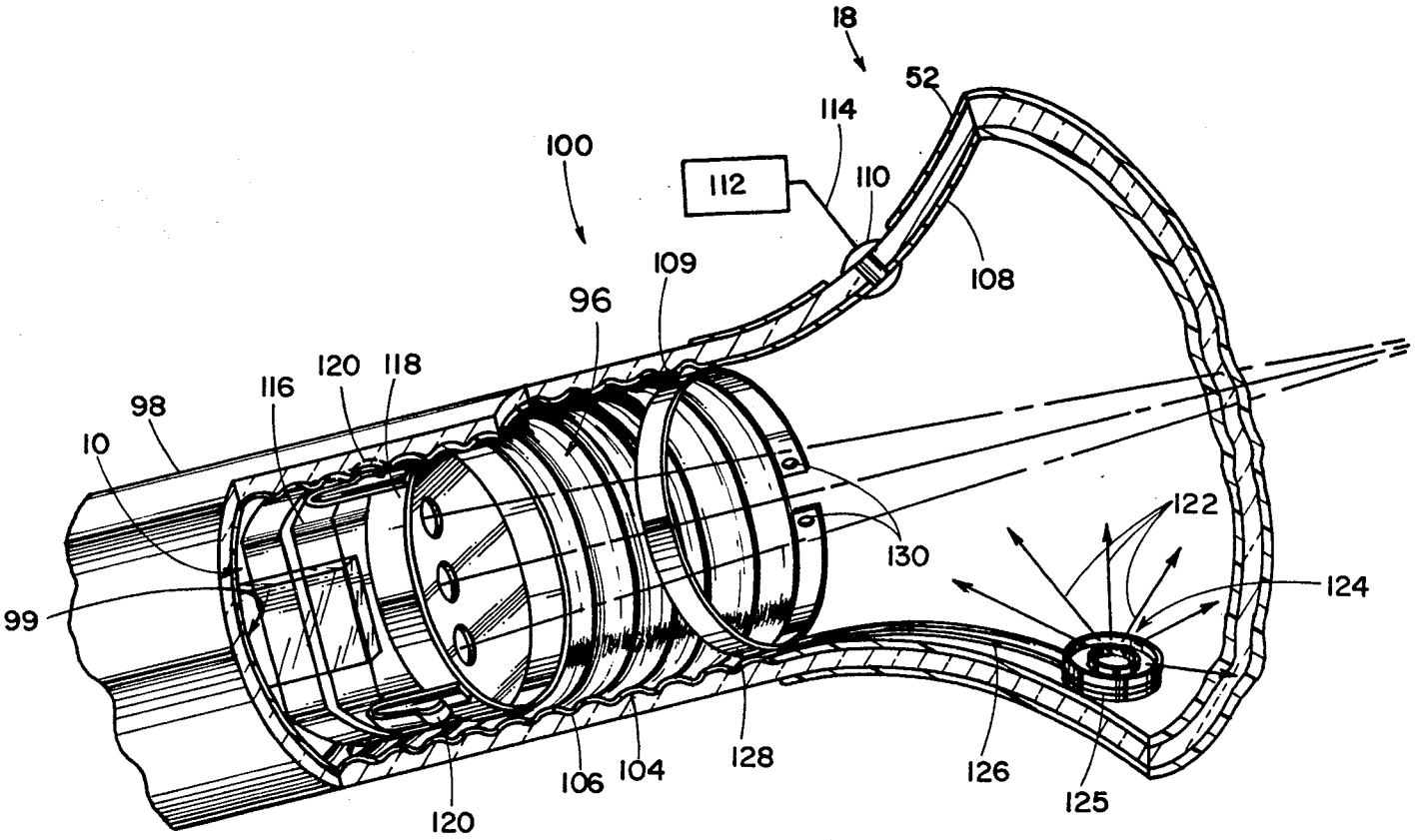
124
122
125
126
108
52
18
110
114
112
130
128
109
104
96
106
100
120
118
120
116
98
10
99

GETTER SUPPORT MEANS FOR TELEVISION CATHODE RAY TUBES

CROSS-REFERENCE TO RELATED PATENT APPLICATION

This application is a division of application Ser. No. 708,817 filed July 26, 1976, assigned to the assignee of this invention.

BACKGROUND OF THE INVENTION AND PRIOR ART STATEMENT

This invention relates generally to television cathode ray tubes, and more particularly to means for supporting the getter in such tubes.

The use of the getter is old in electron tube art. The function of the getter is to absorb residual gases that remain in the envelope following the vacuum pump air evacuation process. In its most commonly used form, the getter structure comprises a small "pan" containing alloys of which the primary constituent is barium. The pan of getter is positioned close to the inner wall of the tube envelope and is heated to a high temperature, usually about 900° C., by an induction coil located outside the envelope. This heating causes the getter to "flash", vaporizing the alloy and causing an effusion of the vapor in the envelope for the capture of residual gases to make a better vacuum within the envelope. The getter fallout mainly comprises a metallic residue deposited on funnel walls and on components adjacent to the area of the flash.

Problems can arise from the use of getters. One such problem is caused by the composition of the getter fall-out. The fall-out comprises a metallic residue which is electrically conductive, and can act as an electrical shunt. For example, an exposed resistive surface used for arc-suppression in the cathode ray tube can be effectively bypassed and short-circuited by deposits thereon of conductive material produced by the getter flash. Another problem from getter fall-out relates to the high voltage properties of the electron gun. If any substantial increment of metallic residue fall-out finds its way to the high electric field portion of the gun, the gun will be more susceptible to arcing and operating life may be markedly reduced.

As a result of these problems, it has been common prior art practice to locate the pan containing the getter as far away as possible from components affected by getter fall-out. In television cathode ray tubes, the pan of getter material is commonly supported by the electron gun component nearest the faceplate known as the "convergence cup," or "support cup" (as it will be termed hereafter). A structure of this type is shown by Benda in U.S. Pat. No. 3,432,712. Benda discloses a ring-like structure formed as an open trough facing the mask and containing the getter material. This ring-like structure is shown as being supported in coaxial alignment with an electron gun by a post-like positioner extending from the support cup. A similiar structure is disclosed by Johnson in U.S. Pat. No. 3,564,327.

To locate the getter and its fall-out as far as possible from the gun, it has also been common practice to attach the pan of getter to the support cup by means of a longitudinal resilient member which extends into the funnel of the cathode ray tube. As a result of its position against the slanted wall of the funnel of the tube, the effusion of the getter is projected outwardly into the funnel and generally away from the electron gun. This type of getter support structure, which is commonly known as an "antenna getter," is disclosed by Benda et al. in U.S. Pat. No. 3,961,221.

OBJECTS OF THE INVENTION

It is an object of this invention to provide improved getter support means for television cathode ray tubes.

It is a more specific object of the invention to provide a practical means for support of getter assemblies independent of support from electron gun electrodes.

BRIEF DESCRIPTION OF THE DRAWING

The features of the present invention which are believed to be novel are set forth with particularity in the appended claims. The invention, together with further objects of and advantages thereof, may best be understood by reference to the following description taken in conjunction with the annexed drawing. The single FIGURE comprising the drawing is a perspective view partially in section showing getter support means according to the invention, and in which like reference numerals identify like elements.

DESCRIPTION OF THE PREFERRED EMBODIMENT

The drawing shows a configuration which will be readily recognized by those skilled in the art as a fragment of a television cathode ray tube 100. The fragment comprises the area of joinder of the neck 98 and the funnel 18 of tube 100. The evacuated envelope includes a faceplate (not shown) on the inner surface of which is disposed a pattern of red-, green-, and blue-emissive phosphor elements. Getter means 124 are provided within the envelope of tube 100 for projecting, when flashed, getter material effective to capture residual gases.

Funnel 18 has on the internal surface an inner conductive coating 108. Inner conductive coating 108 is supplied with a high voltage by feed-through conductor 110 connected to power supply 112 (shown schematically), through conductor 114, for receiving a high voltage charge. Inner conductive coating 108 comprises a thin coating of electrically conductive material, commonly a compound containing graphite. A complementary conductive coating 52 is deposited on the outer surface of funnel 18, and is physically and electrically isolated from contact with feed-through conductor 110 by peripheral spaces between conductor 110 and coating 52, as shown. The two conductive coatings 52 and 108, together with the glass wall of funnel 18 (a dielectric), form a capacitor. This capacitor serves as a component of a high-voltage filter circuit for power supply 112, as is well known in the art.

An electron gun 10 is shown as being located within the neck 98 of cathode ray tube 100. The fragment of the gun as illustrated is shown as being a unitized, in-line type of gun that generates three coplanar electron beams as shown which converge and selectively energize the aforedescribed pattern of phosphor elements. Gun 10 has a series of electron-beam-forming and focusing electrodes including a high voltage element 116. High voltage element 116 is physically and electrically connected to a relatively shallow gun support cup 118 from which gun-centering and gun-supporting resilient spring means 120 extend in directions backwardly and outwardly.

Tube 100 is an arc-suppressing television cathode ray tube which includes an open-ended, electrically resistive arc-suppression means 96 embodied in an internal surface 99 of neck 98, and in electrical contact with inner conductive coating 108. Arc-suppression means 96 is coaxial with electron gun 10 and is electrically connected in an electrical path between inner conductive coating 108 and high voltage element 116. The surface of arc-suppression means 96 is physically exposed to the deposit of getter material when getter means 124 is flashed. Arc-suppression means 96 includes axially spaced, alternating lands 104 and grooves 106 distributed across the surface for shadowing at least portions of the exposed surface of arc-suppression means 96 from a deposit of a getter material from getter 124, the effusion of which is indicated by arrows 122. As a result, the creation of an electrically conductive shorting path capable of permitting an arc to by-pass or substantially nullify arc-suppression means 96 is prevented. The arc-suppressing television cathode ray tube is fully described and claimed in the referent copending application Ser. No. 708,817.

It is well-known practice to position and support a getter assembly by means of attachment to the convergence cup, or "gun support cup." With regard to the configuration heretofore described which shows a relatively shallow support cup 118, a novel means according to the invention is used to support the getter assembly.

In accord with the teachings of this invention, an improved getter support means comprises an expansible member, the circumference of which while relaxed is greater than the circumference of the inner surface of the neck of the recipient tube. The expansible member according to the invention is structured so as to be retained in the tube by the outward, self-retaining pressure of the member on the inner surface of the neck adjacent to the junction of the neck funnel of the cathode ray tube. The expansible member means provides for the support of getter means by attachment of the getter means to the expansible member.

A preferred embodiment of the invention comprises getter support means for supporting getter 124 in the form of an expansive split spring collar 128, and shown as having attached thereto resilient spring means 126. A getter container, or "pan" 125 is shown as being attached to the opposite end of resilient spring means 126. The assembly comprising resilient spring means 126 and getter pan 125 is commonly known as an "antenna getter." The effusion of the getter 124 within the tube envelope is indicated by arrows 122. Collar 128 comprises expansive spring means having a circumference while relaxed which is greater than the circumference of the inner surface 99 of neck 12. As a result, after retraction and installation in the neck, collar 128 exerts an outward, self-retaining pressure on the inner surface of 99 or neck 12 adjacent to the junction of neck 12 and funnel 18, according to the invention.

Collar 128 is shown as having extending from its inner surface a plurality of tab means 130, shown in this example as being two in number. Tab means 130 provide for gripping and retracting collar 128 during its installation in a cathode ray tube.

Other changes may be made in the above-described apparatus without departing from the true spirit and scope of the invention herein involved, and it is intended that the subject matter in the above depiction shall be interpreted as illustrative and not in a limiting sense.

We claim:

1. Getter support means for a television cathode ray tube including a funnel and a neck, said getter support means comprising an expansible member, the circumference of which while relaxed is greater than the circumference of the inner surface of the neck of the recipient tube, said expansible member being structured so as to be retained in the tube by the outward, self-retaining pressure of said member on said inner surface of said neck adjacent to the junction of said neck and said funnel, said expansible member providing for the support of getter means by attachment of said getter means to said member.

2. Getter support means for a television cathode ray tube including a funnel and a neck, said getter support means comprising an expansive split spring collar the circumference of which while relaxed is greater than the circumference of the inner surface of the neck of the recipient tube, said getter support means being structured so as to be retained in the tube by the outward, self-retaining pressure of said collar on said inner surface of said neck adjacent to the junction of said neck and said funnel, said getter support means providing for the support of getter means by attachment of said getter means to said collar.

3. The getter support means defined by claim 2 wherein said collar has extending from an inner surface thereof a plurality of tab means for gripping and retracting said collar during installation of said getter support means in said cathode ray tube.

4. An antenna getter assembly for a television cathode ray tube including a funnel and a neck, said getter assembly comprising, in combination, an expansive split spring collar, the circumference of which while relaxed is greater than the circumference of the inner surface of the neck of the recipient tube, a pan containing a quantity of getter material, and resilient spring means for resiliently coupling said pan to said collar, said assembly being structured so as to be retained in the tube by the outward, self-retaining pressure of said collar on said inner surface of said neck adjacent to the junction of said neck and said funnel.

5. Getter support means for a television cathode ray tube including a funnel and a neck, said getter support means comprising an expansive split ring collar, the circumference of which while relaxed is greater than the circumference of the inner surface of the neck of the recipient tube, said getter support means being structured so as to be retained in the tube by the outward, self-retaining pressure of said collar on said inner surface of said neck adjacent to the junction of said neck and said funnel, said collar having extending from an inner surface thereof a plurality of tab means for gripping and retracting said collar during installation of said getter support means in said cathode ray tube.

6. For use in an arc-suppressing television cathode ray tube comprising an evacuated envelope including a neck and a funnel having on an internal surface thereof an inner conductive coating for receiving a high voltage charge, said tube further comprising an electron gun located in a neck of the tube and having a series of electron-beam forming and focusing electrodes including a high voltage element, and getter means within said envelope for projecting, when flashed, getter material effective to capture residual gases in said evacuated envelope in said tube, and including an open-ended, electrically resistive arc-suppression means embodied in an inner surface of said neck and in electrical contact with said inner conductive coating, with said arc-suppression means being coaxial with said gun and electrically connected in an electrical path between said inner conductive coating and said high voltage element, an improved getter support means comprising, in combination, an expansible member the circumference of which while relaxed is greater than the inner surface of the neck of the recipient tube, said expansible member being structured so as to be retained in the tube by the outward, self-retaining pressure of said expansible member on said inner surface of said neck adjacent to the junction of said neck and said funnel said member providing for the support of getter means by attachment of said getter means to said member.

7. For use in an arc-suppressing television cathode ray tube comprising an evacuated envelope including a neck and a funnel having on an internal surface an inner conductive coating for receiving a high voltage charge, said tube further comprising an electron gun located in said neck and having a series of electron-beam forming and focusing electrodes including a high voltage element, and getter means within said envelope for projecting, when flashed, getter material effective to capture residual gases in said evacuated envelope in said tube, and including an open-ended, electrically resistive arc-suppression means embodied in an inner surface of said neck and in electrical contact with said inner conductive coating, with said arc-suppression means being coaxial with said gun and electrically connected in an electrical path between said inner conductive coating and said high voltage element, and having a surface physically exposed to the deposit of said getter material when said getter is flashed, said arc-suppression means including axially spaced, alternating lands and grooves distributed across said surface for shadowing at least portions of said exposed surface from a deposit of said getter material to prevent the creation of an electrically conductive shorting path capable of permitting an arc to by-pass of substantially nullify said arc-suppression means, an improved antenna getter assembly comprising, in combination, an expansive split spring collar, the circumference of which while relaxed is greater than the circumference of the inner surface of the neck of the recipient tube, a pan containing a quantity of getter material, and resilient spring means for resiliently coupling said pan to said collar, said assembly being structured so as to be retained in the tube by the outward, self-retaining pressure of said collar on said inner surface of said neck adjacent to the junction of said neck and said funnel.

8. The antenna getter assembly defined by claim 7 wherein said collar has extending from an inner surface thereof a plurality of tab means for gripping and retracting said collar during installation of said getter support means in said cathode ray tube.

* * * * *